US011146023B2

(12) United States Patent
Ohfuku et al.

(10) Patent No.: US 11,146,023 B2
(45) Date of Patent: Oct. 12, 2021

(54) CONNECTOR CONNECTION STRUCTURE AND CONNECTOR

(71) Applicants: YAZAKI CORPORATION, Tokyo (JP); HONDA MOTOR CO., LTD., Tokyo (JP)

(72) Inventors: Ryosuke Ohfuku, Makinohara (JP); Kazuyuki Iwashita, Wako (JP); Taro Shimizu, Wako (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/893,267

(22) Filed: Jun. 4, 2020

(65) Prior Publication Data

US 2020/0388963 A1 Dec. 10, 2020

(30) Foreign Application Priority Data

Jun. 4, 2019 (JP) ..... JP2019-104557

(51) Int. Cl.
*H01R 13/639* (2006.01)
*H01R 13/436* (2006.01)

(52) U.S. Cl.
CPC ..... *H01R 13/639* (2013.01); *H01R 13/436* (2013.01); *H01R 2201/26* (2013.01)

(58) Field of Classification Search
CPC ..... H01R 13/639; H01R 13/436; H01R 2201/26; H01R 13/6273; H01R 13/6275; H01R 13/7032; H01R 13/635
See application file for complete search history.

(56) References Cited

U.S. PATENT DOCUMENTS 6,910,902 B2 * 6/2005 Osada ..... B60R 21/26 439/188
9,017,090 B2 * 4/2015 Matsumoto ..... H01R 13/635 439/350
2015/0111409 A1 * 4/2015 Miyakawa ..... H01R 13/6273 439/357

FOREIGN PATENT DOCUMENTS

JP 6023580 B2 11/2016

* cited by examiner

*Primary Examiner* — Tho D Ta
(74) *Attorney, Agent, or Firm* — Kenealy Vaidya LLP

(57) ABSTRACT

A connector connection structure includes a first connector and a second connector. A second component of the first connector includes a pair of locking arm portions protruding outwardly from an outer periphery of a main body portion of the second component at opposite end portions of the outer periphery. A first component of the first connector includes an abutting surface extending in an up-and-down direction on an inner periphery of a cylindrical portion of the first component and facing toward a rear side of the first connector in a fitting direction. The pair of locking arm portions and the abutting surface have a structure in which at least one part of a tip surface of the locking arm portions first receives a force from the abutting surface when the tip surface receives the force on the rear side in the fitting direction from the abutting surface.

9 Claims, 18 Drawing Sheets

CONNECTOR CONNECTION STRUCTURE AND CONNECTOR

CROSS-REFERENCE TO RELATED APPLICATIONS

This application is based on and claims priority under 35 USC 119 from Japanese Patent Application No. 2019-104557 filed on Jun. 4, 2019, the contents of which are incorporated herein by reference.

TECHNICAL FIELD

The present disclosure relates a connector connection structure and a connector.

BACKGROUND ART

In a related art, disclosed is a connector connection structure in which a first connector on the side of an inflator provided in the inflator of an in-vehicle airbag system and a second connector on the side of a wire harness that supplies a control signal to the inflator are fitted to each other (for, example, refer to Japanese Patent No. 6023580).

For example, in the connector connection structure described in Japanese Patent No. 6023580, the first connector includes a bottomed cylindrical holder fixed to the inflator, and a shunt ring fitted to the holder. The holder and the shunt ring are fixed to each other by causing a pair of locking arm portions protruding from an outer periphery of the shunt ring to be engaged with a groove formed on an inner periphery of the holder.

SUMMARY OF INVENTION

Meanwhile, a mode in which an impact in a direction of separating the first connector and the second connector from each other (a direction in which the first connector and the second connector move to the rear side in a fitting direction) is applied to the first connector and the second connector that are fitted to each other due to activation (ignition) of the inflator, may occur. When the above-described impact mode occurs, the pair of locking arm portions of the shunt ring receive a reaction force from the groove of the holder to the rear side in the fitting direction by receiving an impact in a direction in which the shunt ring relatively moves to the front side in the fitting direction with respect to the holder.

According to the study of the present inventor, as described above, when the pair of locking arm portions of the shunt ring receive the reaction force from the groove of the holder to the rear side in the fitting direction, it becomes clear that depending on the structure of the first and second connectors, excessive compressive stress caused by stress concentration is easy to act on an end of a root part of the locking arm portion. Therefore, it is desired to easily disperse the compressive stress acting on the root part of the locking arm portion without changing a basic structure of the first and second connectors.

The present disclosure provides a connector connection structure and a connector in which compressive stress acting on a root part of a locking arm portion is easily dispersed.

According to a first illustrative aspect of the present disclosure, a connector connection structure includes: a first connector; and a second connector. The first connector and the second connector are fitted to each other at front sides thereof in a fitting direction in which the first connector and the second connector approach to each other. The first connector includes: a first component including a cylindrical portion having a center axial line of the first component; and a second component including a main body portion, the main body portion being housed inside the cylindrical portion and internally defining a fitting port to which the second connector is fitted. The second component includes a pair of locking arm portions protruding outwardly from an outer periphery of the main body portion at opposite end portions of the outer periphery in a width direction orthogonal to the fitting direction, the locking arm portions having a tip surface, the tip surface facing toward the front side of the first connector in the fitting direction and extending in an up-and-down direction orthogonal to the fitting direction and the width direction. The first component includes an abutting surface extending in the up-and-down direction on an inner periphery of the cylindrical portion and facing toward the rear side of the first connector in the fitting direction, the abutting surface being configured to abut on the tip surface of each of the locking arm portions in the fitting direction. The second connector includes: a housing having a connection portion which is fitted to the fitting port; and a locking mechanism configured to lock the main body portion and the connection portion with each other, such that a fitted state where the connection portion is fitted to the fitting port is not released. The locking mechanism is provided at a location away from the center axial line of the cylindrical portion to one side in the up-and-down direction. The pair of locking arm portions and the abutting surface have a structure configured such that at least one part of the tip surface in the up-and-down direction first receives a force from the abutting surface when the tip surface of the locking arm portions receives the force on the rear side in the fitting direction from the abutting surface.

According to a second illustrative aspect of the present disclosure, the structure includes a tapered surface inclining to be located at the rear side of the first connector in the fitting direction as approaching an end of the one side in the up-and-down direction on the tip surface in the up-and-down direction, the tapered surface being formed in a region of the tip surface of the locking arm portions at the one side in the up-and-down direction.

According to a third illustrative aspect of the present disclosure, the second connector includes a slider held in the housing to be movable in the fitting direction at a location away from the center axial line of the cylindrical portion to the one side in the up-and-down direction, the slider being energized toward the front side of the second connector in the fitting direction with an energizing member. The first connector and the second connector are configured such that, during a fitting operation of the first connector and the second connector, the front sides of the first connector and the second connector in the fitting direction approach to each other while the slider resists an energizing force of the energizing member applied to the first connector, the energizing force being caused by abutting on the slider and the first connector. In which the slider is designed to: keep the front sides of the first connector and the second connector in the fitting direction away from each other by the energizing force of the energizing member, in an incomplete fitted state where the first connector and the second connector are incompletely fitted to each other: and prevent the locking mechanism from being deformed in a direction of releasing locking the main body portion and the connection portion by engaging the slider and the locking mechanism, in a complete fitted state where the first connector and the second connector are completely fitted to each other.

According to a fourth illustrative aspect of the present disclosure, the first connector and the second connector are electrical connectors of an in-vehicle airbag system, the first connector corresponding to a connector at a side of an inflator provided in the inflator of the airbag system, the second connector corresponding to a connector at a side of a wire harness which supplies a control signal to the inflator.

According to a fifth illustrative aspect of the present disclosure, a connector configured to be fitted to a counterpart connector at front sides thereof in a fitting direction in which the connector and the counterpart connector approach to each other. In which the connector includes: a first component including a cylindrical portion having a center axial line of the first component; and a second component including a main body portion, the main body portion being housed inside the cylindrical portion and internally defining a fitting port to which the counterpart connector is fitted. The second component includes a pair of locking arm portions protruding outwardly from an outer periphery at opposite end portions of the outer periphery in a width direction orthogonal to the fitting direction, the locking arm portions having a tip surface, the tip surface facing toward the front side of the connector in the fitting direction and extending in an up-and-down direction orthogonal to the fitting direction and the width direction. The first component includes an abutting surface extending in the up-and-down direction on an inner periphery of the cylindrical portion and facing toward the rear side of the connector in the fitting direction, the abutting surface being configured to abut on the tip surface of each of the locking arm portions in the fitting direction. The counterpart connector includes: a housing having a connection portion which is fitted to the fitting port; and a locking mechanism configured to lock the main body portion and the connection portion with each other, such that a fitted state where the connection portion is fitted to the fitting port is not released. The locking mechanism is provided at a location away from the center axial line of the cylindrical portion to one side in the up-and-down direction. The pair of locking arm portions and the abutting surface have a structure configured such that at least one part of the tip surface in the up-and-down direction first receives a force from the abutting surface when the tip surface of the locking arm portions receives the force on the rear side in the fitting direction from the abutting surface.

In the connector connection structure according to the first aspect of the present disclosure, as described above, when a mode, in which an impact in a direction of separating the first connector and second connector from each other (a direction in which the first connector and the second connector move to the rear side in the fitting direction) is applied thereto due to activation (ignition) of the inflator, occurs, the locking mechanism for causing the main body portion of the second component on the side of the first connector (a shunt ring) and the connection portion of the housing on the side of the second connector first to be locked to each other receives an impact in a direction of separating the main body portion and the connection portion from each other (a direction in which the first connector and the second connector move to the rear side in the fitting direction). When the locking mechanism receives the above-described impact, next, the second component (the shunt ring) receives an impact in a direction of relatively moving to the front side in the fitting direction with respect to the first component (a holder). When the second component receives the above-described impact, the tip surfaces of the pair of locking arm portions of the second component receive a reaction force from the abutting surface of the first component to the rear side in the fitting direction.

Here, due to a fact that the locking mechanism is provided at the location away from the center axial line of the cylindrical portion to one side in the up and down direction, the second component receives the impact force in the direction of relatively moving to the front side in the fitting direction with respect to the first component at the location away from the center axial line to one side in the up and down direction. Therefore, the tip surfaces of the pair of locking arms first receive the reaction force from the abutting surface of the first component to the rear side in the fitting direction at a location closer to one side in the up and down direction.

Therefore, when both the tip surface of the locking arm portion and the abutting surface of the first component have a simple shape that extends linearly in the up and down direction over the whole region of a range in the up and down direction in which the both thereof can contact each other, the tip surface of the locking arm portion is easy to first receive the reaction force from the abutting surface only at one side end in the up and down direction. As a result, excessive compressive stress caused by stress concentration is easy to act on one side end in the up and down direction at a root part of the locking arm portion.

On the other hand, in the configuration, when the tip surface of the locking arm portion receives a force on the rear side in the fitting direction from the abutting surface, the pair of locking arm portions and the abutting surface adopt a structure in which an intermediate place in the up and down direction of the tip surface first receives the force from the abutting surface. Therefore, in comparison with a mode in which only one side end in the up and down direction of the tip surface first receives the force from the abutting surface, the compressive stress acting on the root part of the locking arm portion is easily dispersed in the up and down direction.

In the connector connection structure according to the second aspect of the present disclosure, a place which is the intermediate place in the up and down direction of the tip surface and where the tapered surface starts is easy to first receive the force from the abutting surface. As a result, the above-described structure can be realized with a simple structure.

In the connector connection structure according to the third aspect of the present disclosure, in the incompletely fitted state, since the slider acts to keep the front sides of the first and second connectors in the fitting direction away from each other, an abnormality in the incompletely fitted state is easily detected. In the completed fitted state, since the slider is engaged with the locking mechanism and prevents the locking mechanism from being deformed in the direction of releasing the locking between the main body portion and the connecting portion (a so-called double locking function is performed), it is possible to more reliably prevent occurrence of the state in which the first and second connectors are unintentionally separated from each other.

Since the slider is provided at the location away from the center axial line of the cylindrical portion in the housing to one side in the up and down direction, a wire harness extending from the rear side in the fitting direction of the housing easily extends toward the other side in the up and down direction without being disturbed by the existence of the slider.

In the connector connection structure according to the fourth aspect of the present disclosure, since the compressive stress acting on the root part of the locking arm portion is easily dispersed in the up and down direction when the inflator of the airbag system starts, durability of the locking arm portion (and further, durability of the connector connection structure) is improved.

In the connector according to the fifth aspect of the present disclosure, in the same manner as the connector connection structure of the above-described configuration [1], in comparison with the mode in which only one side end in the up and down direction of the tip surface first receives the force from the abutting surface, the compressive stress acting on the root part of the locking arm portion is easily dispersed in the up and down direction.

According to the present disclosure, it is possible to provide a connector connection structure and a connector in which compressive stress acting on a root part of a locking arm portion is easily dispersed.

Hereinabove, the present disclosure is briefly described. Details of the present disclosure will be further clarified by reading through a mode for implementing the disclosure to be described below (hereinafter, referred to as an "embodiment") with reference to the accompanying drawings.

DESCRIPTION OF EMBODIMENTS

Figure 1:
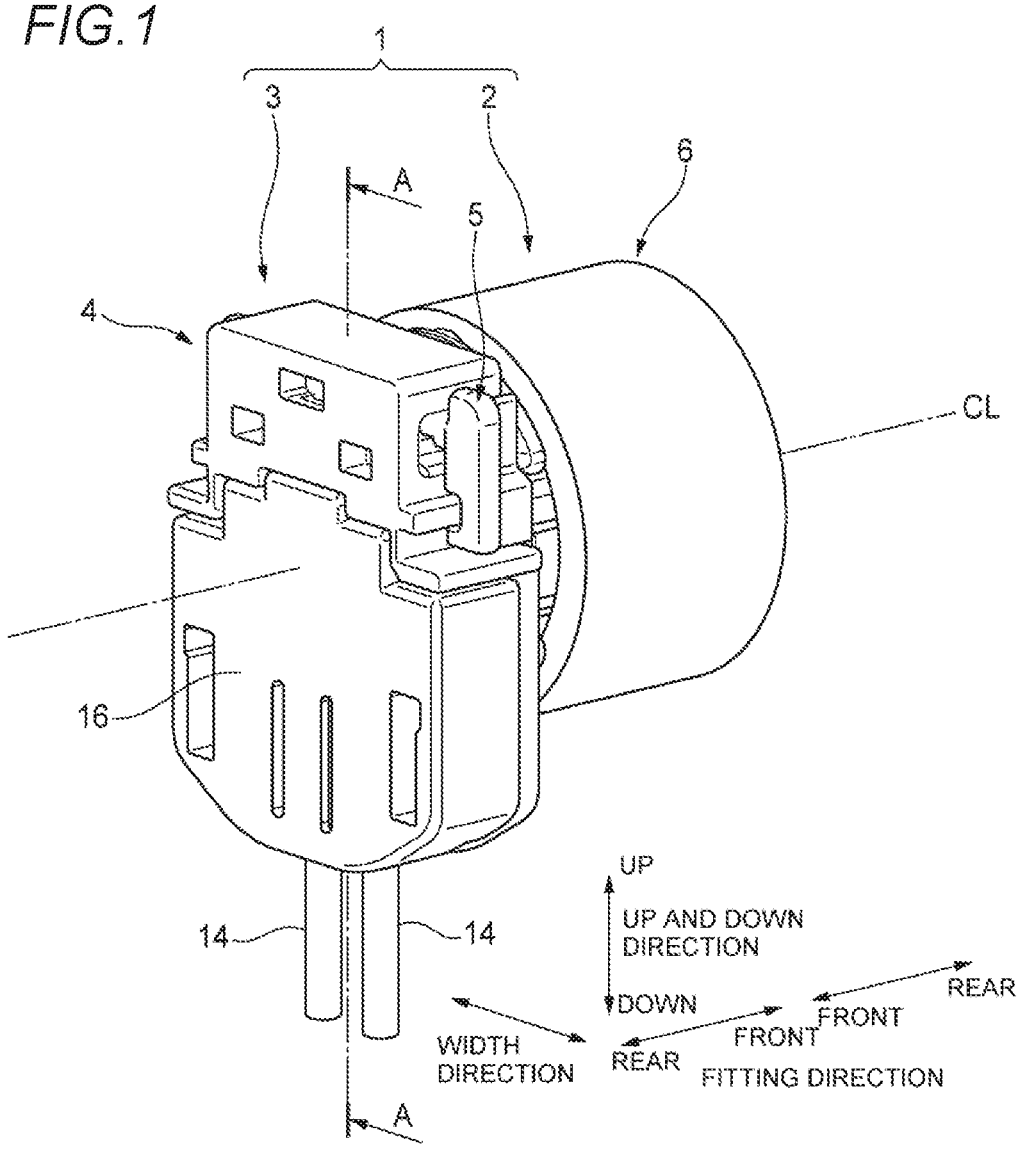
FIG. 1 is a perspective view of a connector connection structure according to an embodiment of the present disclosure.
Figure 2:
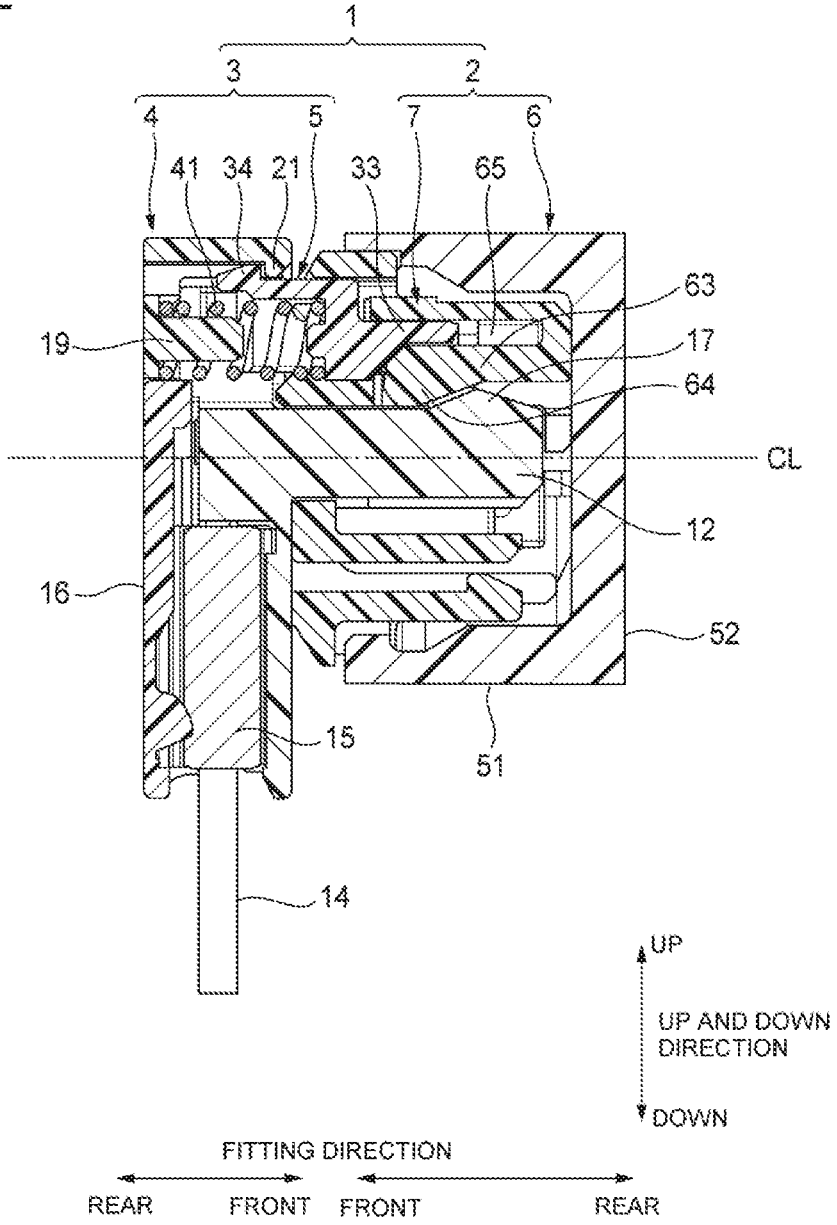
FIG. 2 is a cross-sectional view taken along the line A-A in FIG. 1.

Hereinafter, a connector connection structure 1 according to an embodiment of the present disclosure will be described with reference to the drawings. As illustrated in FIGS. 1 and 2, the connector connection structure 1 has a structure in which a first connector 2 and a second connector 3 are fitted to each other. The first connector 2 corresponds to a "connector" of the present disclosure.

Figure 3:
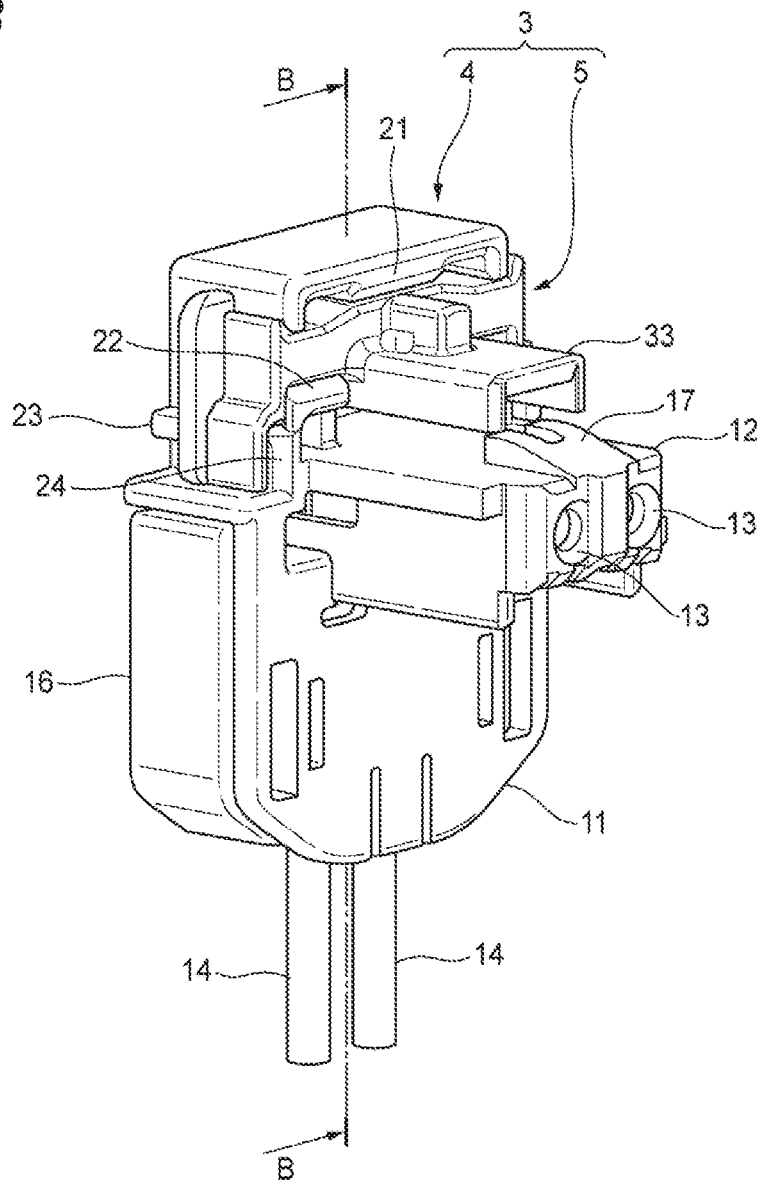
FIG. 3 is a perspective view of a second connector illustrated in FIG. 1.
Figure 4:
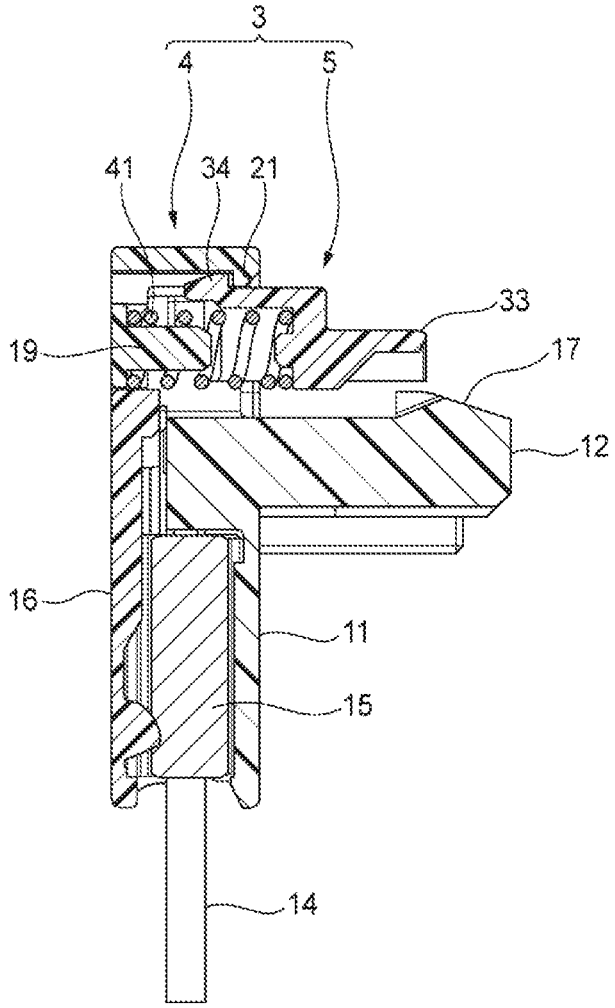
FIG. 4 is a cross-sectional view taken along line B-B in FIG. 3.
Figure 5:
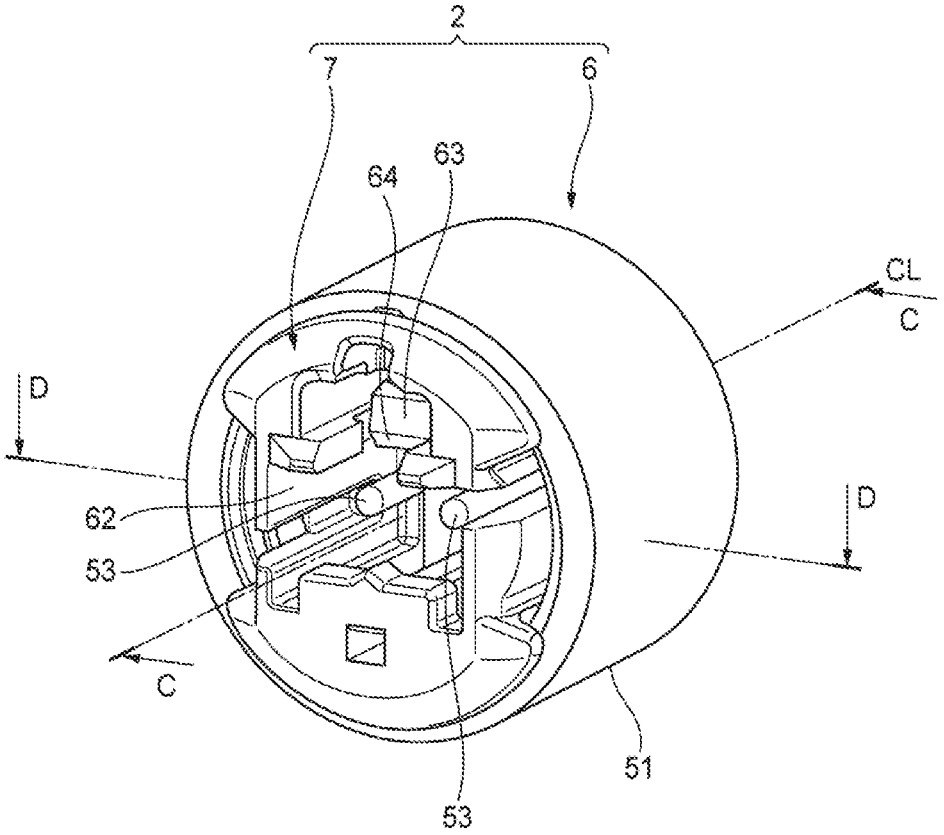
FIG. 5 is a perspective view of a first connector illustrated in FIG. 1.
Figure 6:
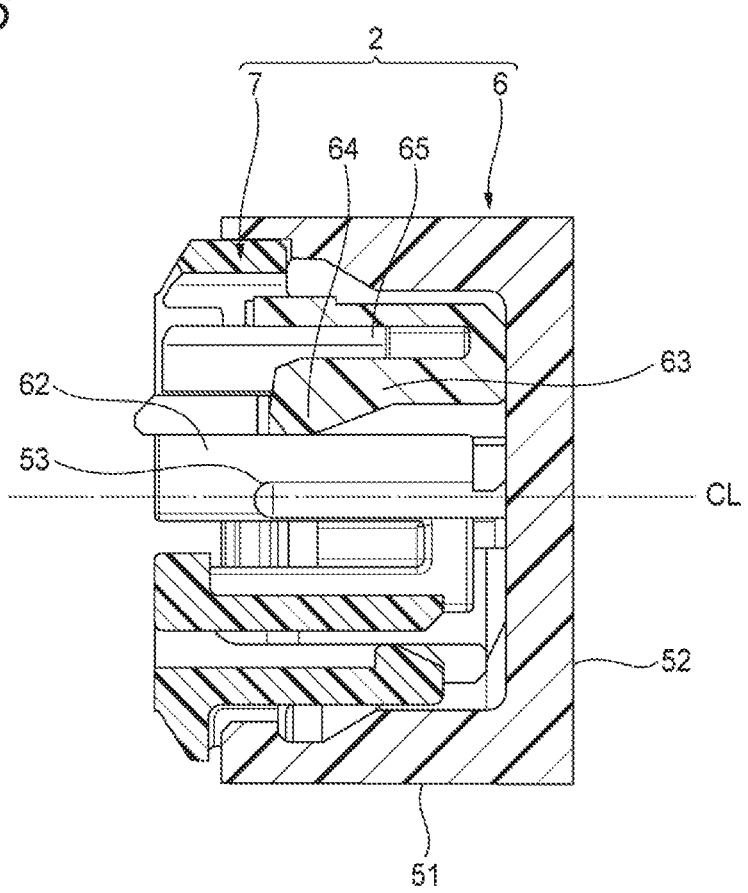
FIG. 6 is a cross-sectional view taken along the line C-C in FIG. 5.
Figure 7:
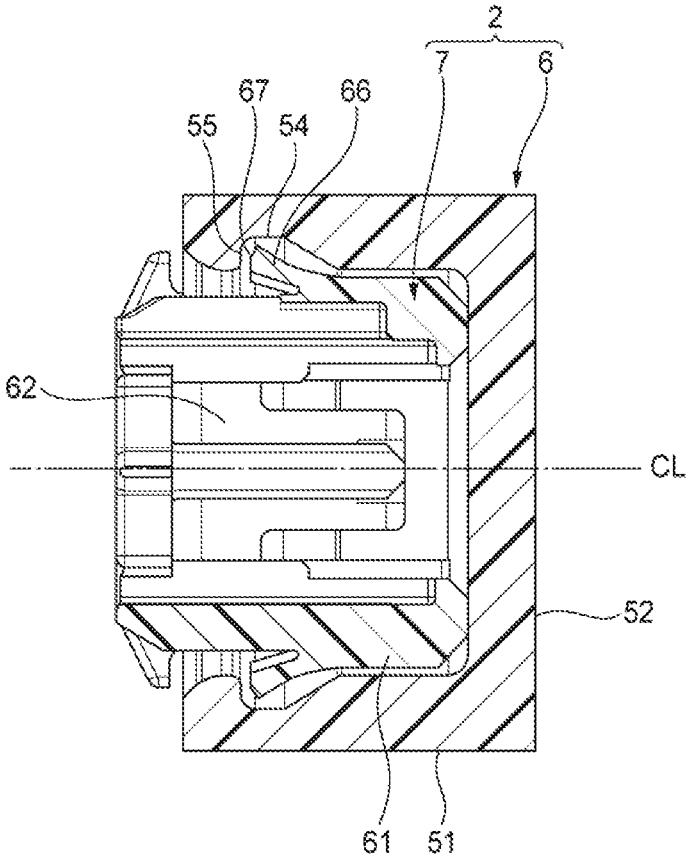
FIG. 7 is a cross-sectional view taken along line D-D in FIG. 5.

The connector connection structure 1 is typically used for an in-vehicle airbag system. Here, the first connector 2 illustrated in FIGS. 5 to 7 is a connector on the inflator side provided in an inflator of the airbag system, and the second connector 3 illustrated in FIGS. 3 and 4 is a connector on the wire harness side that supplies a control signal to the inflator. The connector connection structure 1 is obtained in such a manner that a fitting port 62 of the first connector 2 (refer to FIG. 5) and the connection portion 12 of the second connector 3 (refer to FIG. 3) are fitted to each other.

For the convenience of description, as illustrated in FIGS. 1 and 2, a "fitting direction", a "width direction", an "up and down direction", "front", "rear", "up", and "down" are defined. The "fitting direction", the "width direction", and the "up and down direction" are orthogonal to each other. A front and rear direction of the fitting direction on the side of the first connector 2 is opposite to a front and rear direction of the fitting direction on the side of the second connector 3, and in any of the first and second connectors 2 and 3, the front side in the fitting direction is defined as the front side, and the back side in the fitting direction is defined as the rear side.

First, a configuration of the second connector 3 illustrated in FIGS. 3 and 4 will be described. As illustrated in FIGS. 3 and 4, the second connector 3 includes a housing 4 and a slider 5. The slider 5 is a component slidably mounted on the housing 4 in the fitting direction.

Figure 8A:
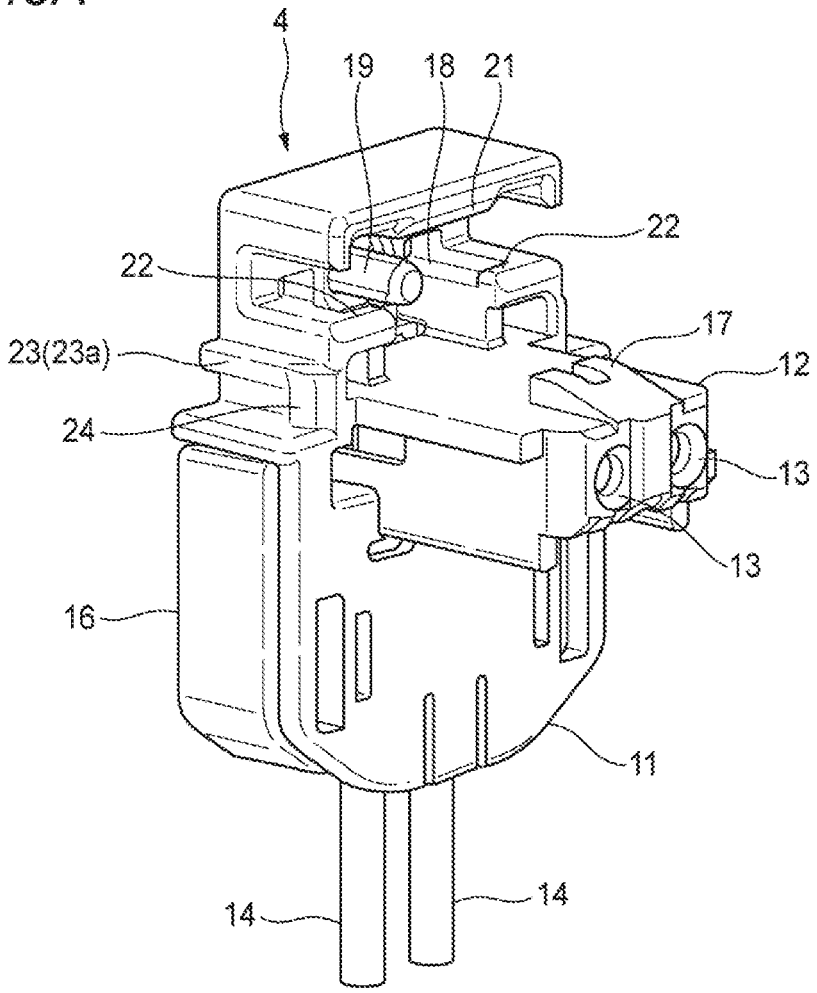
FIG. 8A is a perspective view of a housing illustrated in FIG. 3.

First, the housing 4 will be described. As illustrated in FIG. 8A, the resin housing 4 integrally includes an approximately rectangular parallelepiped main body portion 11 extending in the up and down direction, and an approximately rectangular parallelepiped connection portion 12 protruding from an approximately center portion in the up and down direction of the main body portion 11 to the front side in the fitting direction.

A pair of terminal housing chambers 13 that are opened to the front side in the fitting direction are formed to be arranged in the width direction in the connection portion 12. A pair of metallic female terminals (not illustrated) are housed inside the pair of terminal housing chambers 13. When the first and second connectors 2 and 3 are fitted to each other, the pair of female terminals are electrically connected to a pair of male terminals 53 on the side of the first connector 2 (refer to FIG. 5).

A pair of electric wires 14 are connected to the rear side in the fitting direction of the pair of female terminals. The pair of electric wires 14 connected to the pair of female terminals extend downward inside the main body portion 11, and extend downward from a lower end surface of the main body portion 11. The pair of electric wires 14 extending from the main body portion 11 are connected to a control portion (not illustrated) of the airbag system.

A ferrite core 15 (refer to FIG. 4) is mounted on the pair of electric wires 14 located inside the main body portion 11. Accordingly, a noise current caused by various electromagnetic waves from the outside is prevented from flowing through the pair of electric wires 14. A resin cover 16 is assembled to the main body portion 11 from the rear side in the fitting direction to cover the pair of electric wires 14 on which the ferrite core 15 is mounted.

A protruding portion 17 protruding upward is provided on the tip side of an upper surface of the connection portion 12. The protruding portion 17 has a function of maintaining a fitted state of the first and second connectors 2 and 3 (described later) by engaging with a protruding portion 64 of a fitting arm 63 on the side of the first connector 2 (refer to FIG. 2).

In an upper portion of the main body portion 11 (a portion located on the upper side of the connection portion 12), a slider mounting space 18 which is a recessed portion for mounting the slider 5 is formed to be opened on the front side in the fitting direction and on the opposite sides in the width direction. A column portion 19 extending toward the front side in the fitting direction is provided at a center portion in the width direction of the wall surface of the main body portion 11 that defines the rear side surface in the fitting direction of the slider mounting space 18. The column portion 19 is used to hold an end portion on the rear side in the fitting direction of a coil spring 41 that energizes the slider 5 (refer to FIG. 10).

A stopper portion 21 protruding downward is formed at a center portion in the width direction of a front edge in the fitting direction on the wall surface of the main body portion 11 that defines an upper surface of the slider mounting space 18; and a pair of stopper portions 22 protruding upward are formed on opposite side portions in the width direction of the front edge in the fitting direction on the wall surface of the main body portion 11 that defines a lower surface of the slider mounting space 18.

Figure 8B:
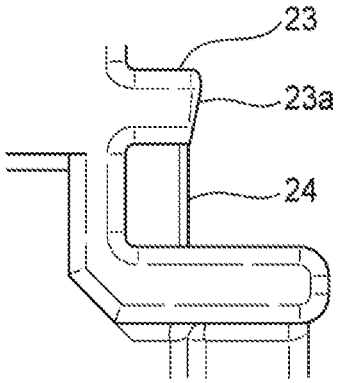
FIG. 8B is an enlarged view of a rib and a stopper portion in FIG. 8A when viewed from the rear side in a fitting direction.

A pair of ribs 23 protruding outward in the width direction and extending in the fitting direction are formed on opposite side surfaces in the width direction of an approximately center portion in the up and down direction of the main body portion 11 (a portion located below the slider mounting space 18). As illustrated in FIG. 8B, a top surface of the rib 23 is formed with a tapered surface 23*a* that is inclined to be located inside in the width direction as going downward in the up and down direction. Action of the tapered surface 23*a* will be described later.

Even at end portions on the front side in the fitting direction of the pair of ribs 23, a pair of stopper portions 24 protruding outward in the width direction are formed at a location adjacent to the lower side of the end portions. Hereinabove, the housing 4 is described.

Figure 9A:
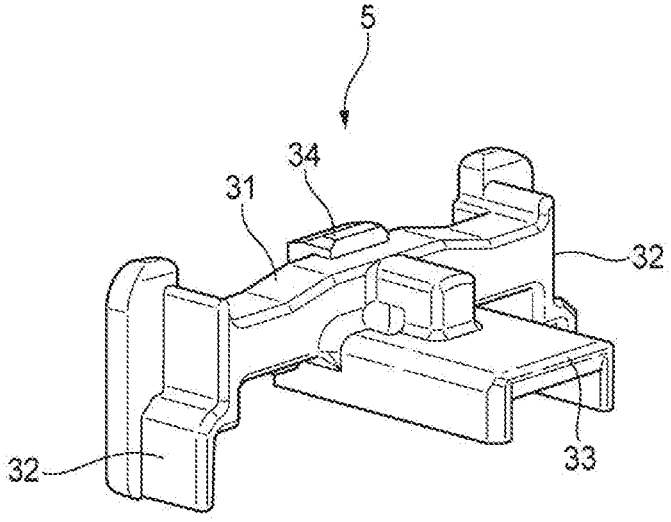
FIG. 9A is a perspective view of a slider illustrated in FIG. 3.
Figure 9B:
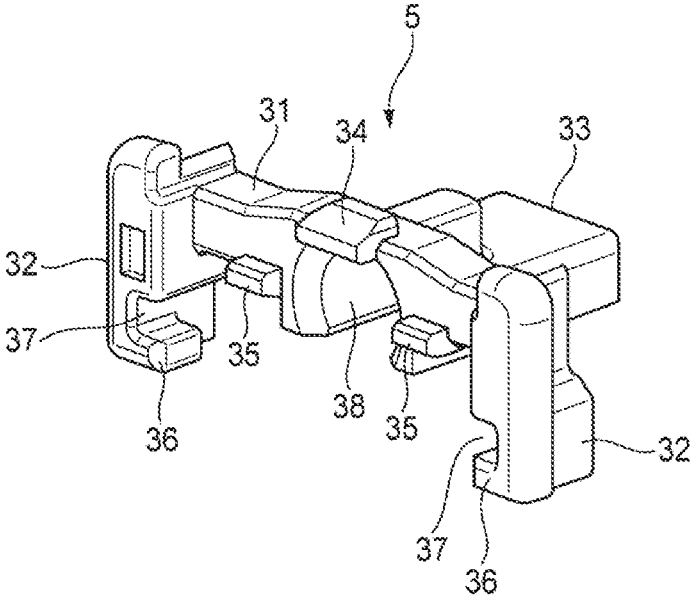
FIG. 9B is a perspective view of the slider viewed from a different direction.

Next, the slider 5 will be described. As illustrated in FIGS. 9A and 9B, the resin slider 5 integrally includes a main body portion 31 extending in the width direction, a pair of hanging portions 32 extending downwardly from opposite end portions in the width direction of the main body portion 31, and a protruding piece 33 protruding from a center portion in the width direction of the main body portion 31 to the front side in the fitting direction.

A protruding portion 34 protruding upward is formed (refer to FIGS. 9A and 9B) at a center portion in the width direction of the rear edge in the fitting direction on an upper surface of the main body portion 31, and a pair of protruding portions 35 protruding downward are formed on opposite side portions in the width direction of the rear edge in the fitting direction on a lower surface of the main body portion 31 (refer to FIG. 9B). The protruding portion 34 and the pair of protruding portions 35 are respectively engaged with the stopper portion 21 and the pair of stopper portions 22 on the side of the housing 4, thereby having a function of preventing the slider 5 from being detached from the housing 4 to the front side in the fitting direction.

A pair of protruding portion 36 protruding inward in the width direction are formed at lower end portions on the inner side surfaces in the width direction of the pair of the hanging portions 32 (refer to FIG. 9B). As a result, a pair of groove portions 37 that are recessed outward in the width direction and extend in the fitting direction are formed on the inner side surfaces in the width direction of the pair of hanging portions 32 (refer to FIG. 9B). The pair of ribs 23 on the side of the housing 4 are fitted to the pair of groove portions 37, whereby the movement in the fitting direction of the slider 5 with respect to the housing 4 is guided. The pair of protruding portions 36 are engaged with the pair of stopper portions 24 on the side of the housing 4, thereby having a function of preventing the slider 5 from being detached from the housing 4 to the front side in the fitting direction.

A recessed portion 38 that is recessed toward the front side in the fitting direction is provided at a center portion in the width direction on the rear side surface in the fitting direction of the main body portion 31. The recessed portion 38 is used to hold a front end portion in the fitting direction of the coil spring 41 for energizing the slider 5 (refer to FIG. 10). Hereinabove, the slider 5 is described.

Figure 10:
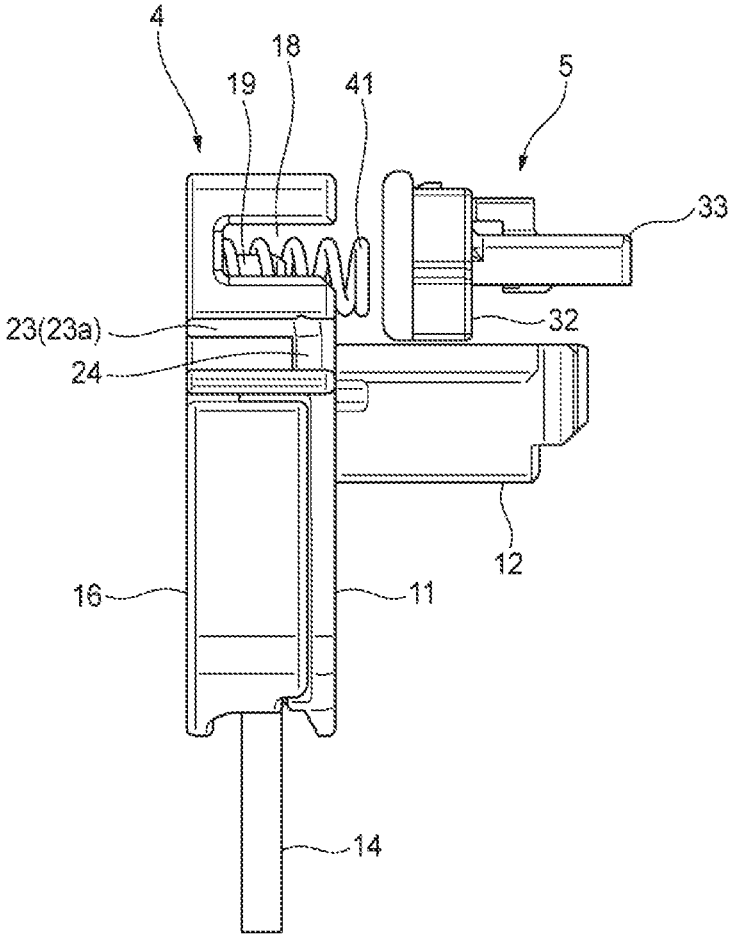
FIG. 10 is a side view illustrating a state when the slider is assembled to the housing.

Next, the assembly of the slider 5 to the housing 4 will be described with reference to FIGS. 10 to 12. As illustrated in FIG. 10, first, a rear end portion in the fitting direction of the coil spring 41 is inserted into the column portion 19 of the housing 4, after which the slider 5 is caused to be close toward the slider mounting space 18 of the housing 4 from the front side in the fitting direction, and the front end portion in the fitting direction of the coil spring 41 is inserted into the recessed portion 38 of the slider 5. The insertion order of opposite end portions of the coil spring 41 may be reversed.

Next, the slider 5 is further moved to be closer toward the slider mounting space 18 while resisting the energizing force of the coil spring 41, and the pair of groove portions 37 of the slider 5 are fitted to the pair of ribs 23 on the side of the housing 4. Here, in the present example, as illustrated in FIG. 11, the slider 5 is displaced upward from an appropriate location that coincides with the fitting of the groove portion 37 and the rib 23 with respect to the housing 4, and in a state where the pair of protruding portions 36 of the slider 5 are in contact with the tapered surfaces 23*a* of the pair of ribs 23, the slider 5 is simply pushed into the rear side in the fitting direction with respect to the housing 4, whereby, as illustrated in FIG. 12, the slider 5 can be automatically assembled thereto at the appropriate location where the groove portion 37 and the rib 23 are fitted to each other.

Figure 11:
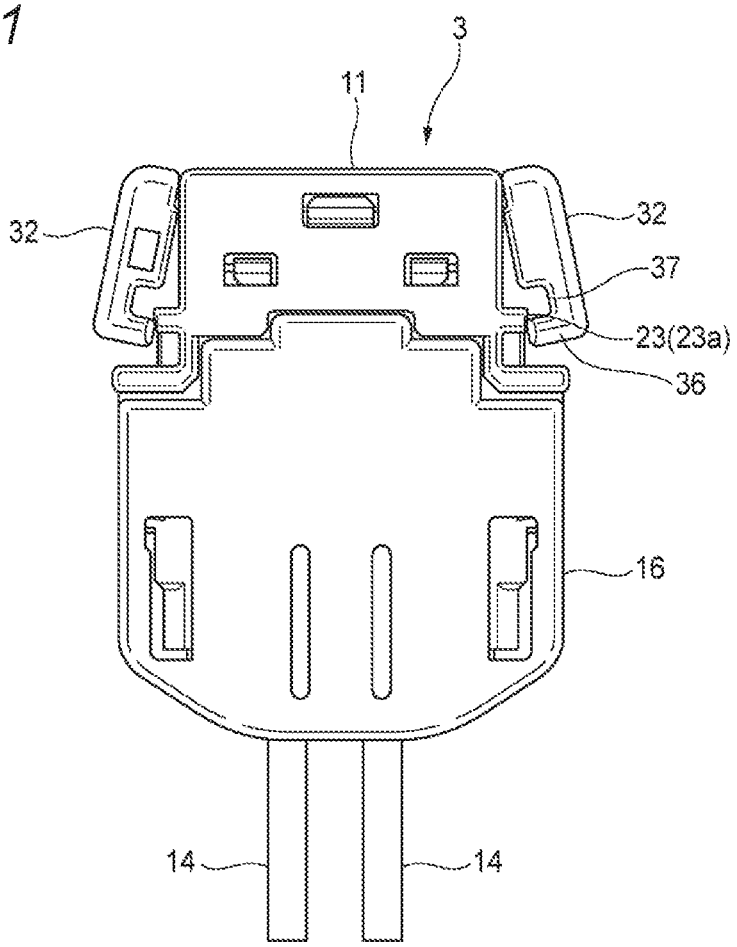
FIG. 11 is a rear view illustrating an intermediate stage of assembling the slider to the housing.
Figure 12:
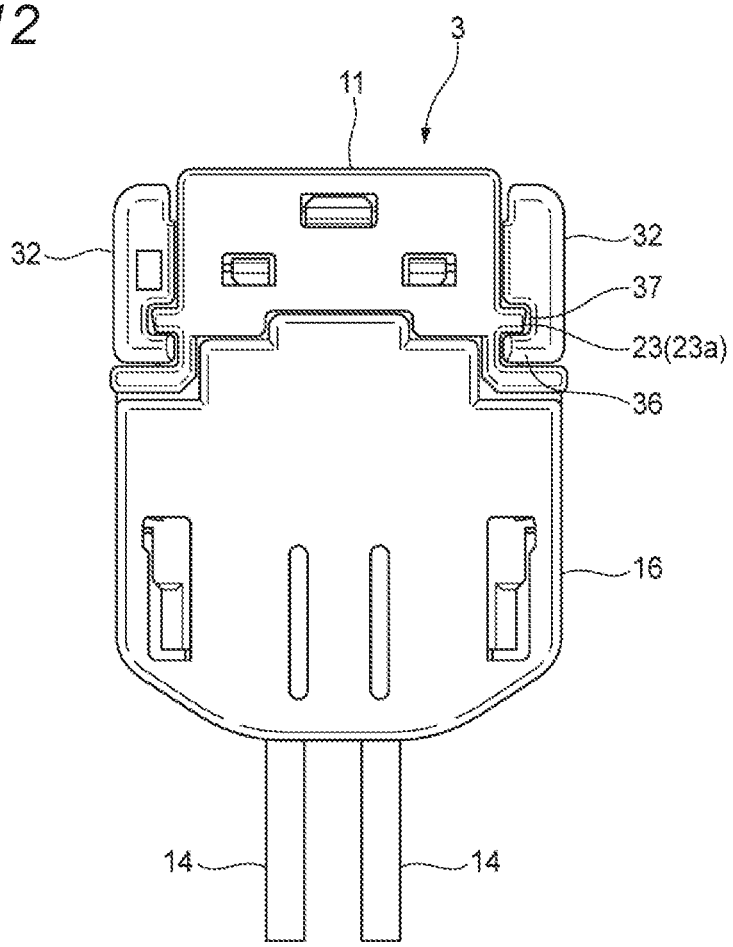
FIG. 12 is a rear view illustrating a stage in which the assembly of the slider to the housing is completed.

That is, as illustrated in FIG. 11, in the state where the pair of protruding portions 36 of the slider 5 are in contact with the tapered surfaces 23*a* of the pair of ribs 23, the pair of protruding portions 36 receive a force outward in the width direction from the tapered surfaces 23*a* of the pair of ribs 23 due to a fact that the groove portion 37 and the rib 23 are not fitted to each other, such that the pair of hanging portions 32 of the slider 5 are in a state of being elastically deformed to be displaced outward in the width direction. The pair of protruding portions 36 press the tapered surfaces 23*a* of the pair of ribs 23 toward the inside in the width direction by an elastic restoring force of the slider 5 elastically deformed as described above.

Here, due to the fact that the tapered surface 23*a* is inclined to be located inside in the width direction as going downward in the up and down direction, a portion of the force by which the pair of protruding portions 36 press the tapered surfaces 23*a* of the ribs 23 acts as a downward force for causing the pair of protruding portions 36 (therefore, the slider 5) to move downward. As a result, in the state where the pair of protruding portions 36 are in contact with the tapered surfaces 23*a* of the pair of ribs 23, when the slider 5 is pushed to the rear side in the fitting direction with respect to the housing 4, the slider 5 receives the downward force and is automatically displaced downward, whereby, as illustrated in FIG. 12, the slider 5 can be automatically assembled thereto at the appropriate location where the groove portion 37 and the rib 23 are fitted to each other.

As described above, after the pair of grooves 37 of the slider 5 are fitted to the pair of ribs 23 on the side of the housing 4 while resisting the energizing force of the coil spring 41, when the force applied to the slider 5 is released, the slider 5 moves to the front side in the fitting direction with respect to the housing 4 by receiving the energizing force of the coil spring 41, after which the protruding portion 34 and the pair of protruding portions 35 of the slider 5 are respectively engaged with the stopper portion 21 and the pair of stopper portions 22 on the side of the housing 4, and the pair of protruding portions 36 of the slider 5 are engaged with the pair of stopper portions 24 on the side of the housing 4. The above-described engagement prevents the slider 5 from being detached from the housing 4 to the front side in the fitting direction.

As described above, the assembly of the slider 5 to the housing 4 is completed, and the second connector 3 illustrated in FIGS. 3 and 4 is obtained. In a state where the assembly of the slider 5 to the housing 4 is completed, the slider 5 is housed in the housing 4 to be slidable in the fitting direction with respect to the housing 4 in a state of being always energized to the front side in the fitting direction by the energizing force of the coil spring 41. When the first and second connectors 2 and 3 are fitted to each other, the slider 5 is located above a center axial line CL of a holder 6 (described later) of the first connector 2 (refer to FIG. 2).

As described above, in the second connector 3, the pair of ribs 23 extending in the fitting direction are engaged with the pair of groove portions 37, whereby the slider 5 can be stably moved in the fitting direction with respect to the housing 4. Since the stopper portion 24 that prevents the slider 5 from being detached from the housing 4 to the front side in the fitting direction is provided at a location where the rigidity adjacent to the end portion on the front side in the fitting direction of the rib 23 is extremely high even when moment rotating with the width direction as an axis acts on the slider 5, a state where the slider 5 is detached from the housing 4 by breaking through the stopper portion 24 is extremely hard to occur.

Next, the first connector 2 illustrated in FIGS. 5 to 7 will be described. As illustrated in FIGS. 5 to 7, the first connector 2 includes the holder 6 and a shunt ring 7 assembled to the holder 6. The holder 6 is mounted on an ignition terminal portion provided on an airbag inflator.

Figure 13A:
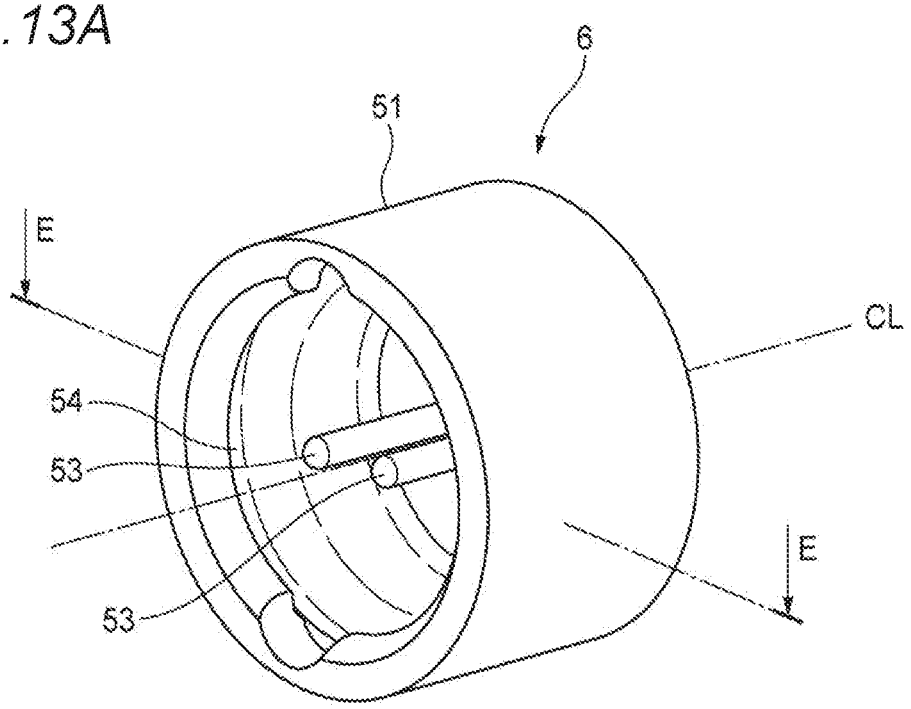
FIG. 13A is a perspective view of a holder illustrated in FIG. 5.
Figure 13B:
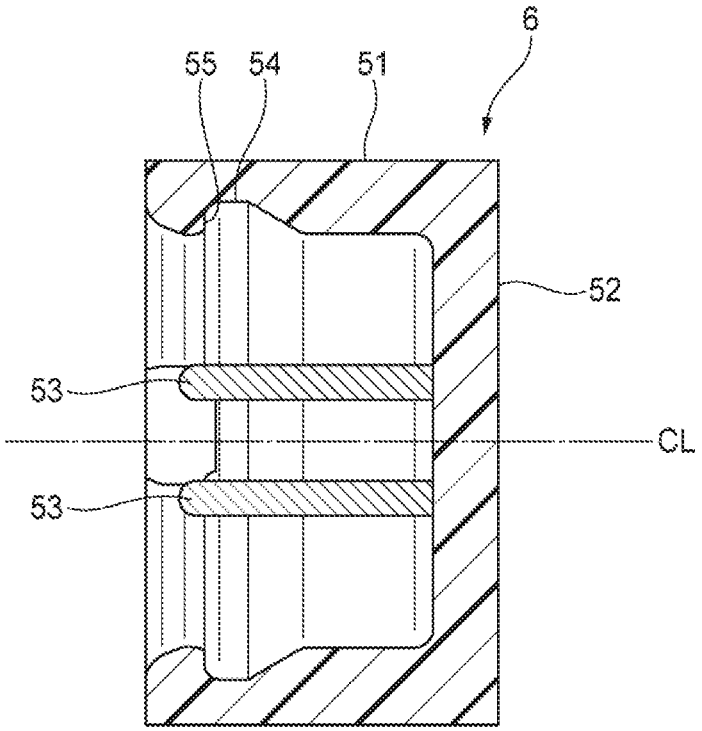
FIG. 13B is a cross-sectional view taken along the line E-E in FIG. 13A.
Figure 14A:
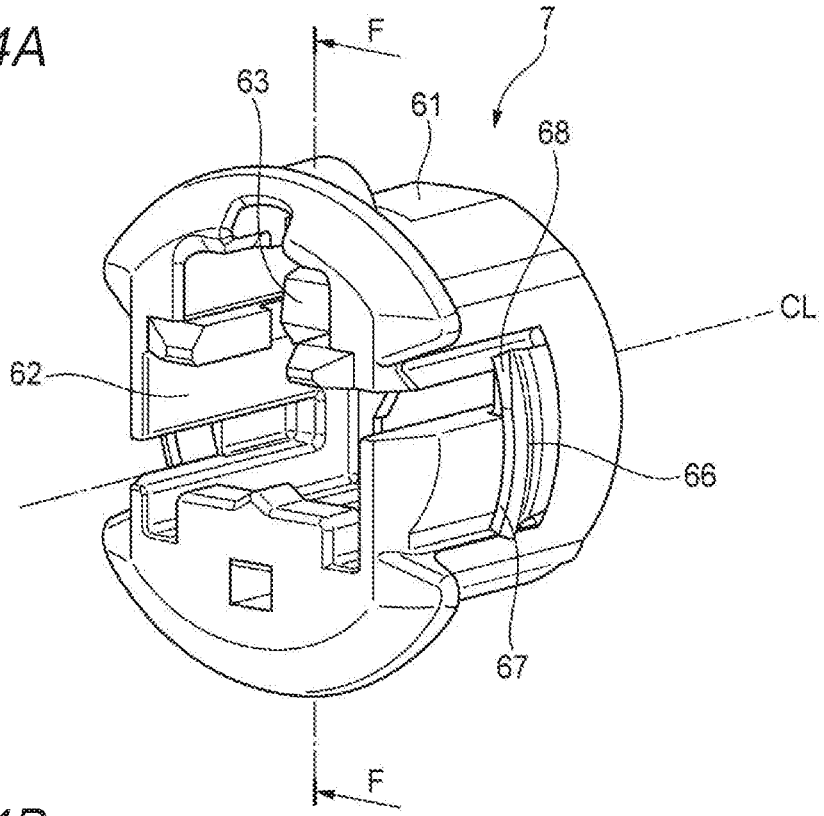
FIG. 14A is a perspective view of a shunt ring illustrated in FIG. 5.
Figure 14B:
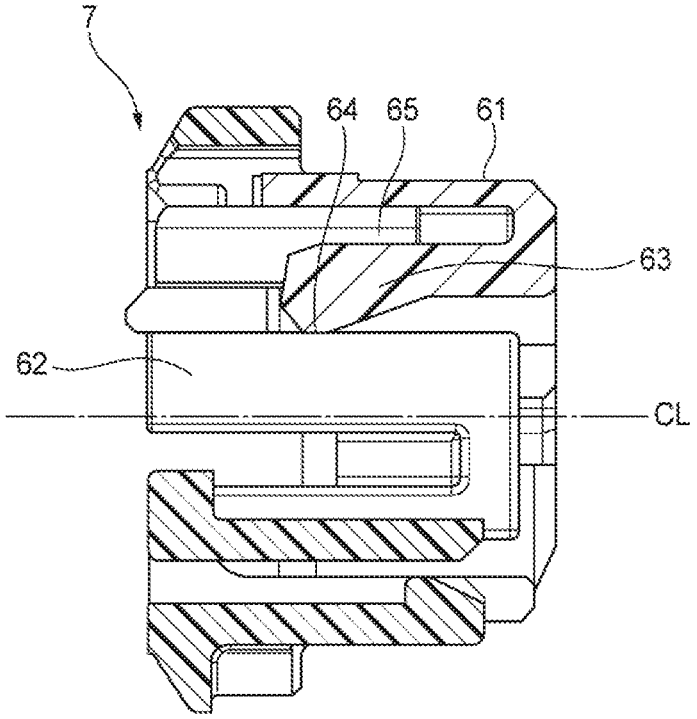
FIG. 14B is a cross-sectional view taken along the line F-F in FIG. 14A.

First, the holder 6 will be described. As illustrated in FIGS. 13A and 13B, the resin holder 6 integrally includes a cylindrical-shaped cylindrical portion 51 having the center axial line CL and a disk-shaped bottom portion 52 that closes an opening on the rear side in the fitting direction of the cylindrical portion 51. The front side in the fitting direction of the cylindrical portion 51 is opened.

In the internal space of the holder 6, the pair of metallic male terminals 53 extending from the bottom portion 52 toward the front side in the fitting direction are provided to be arranged in the width direction. The pair of male terminals 53 are connected to a circuit on the inflator side of the airbag system.

In the inner periphery of a portion on the front side in the fitting direction of the cylindrical portion 51, an annular groove portion 54 recessed outward in a radial direction is formed to extend in a plane perpendicular to the center axial line CL (refer to FIG. 13B). The portion on the front side in the fitting direction on the inner wall surface of the annular groove portion 54 forms a ring-shaped abutting surface 55 facing the rear side in the fitting direction. Therefore, portions of the ring-shaped abutting surface 55, which are located on opposite sides in the width direction, extend in the up and down direction. As such, the portions of the abutting surface 55 facing the rear side in the fitting direction, which are located on the opposite sides in the width direction and extend in the up and down direction, are formed to abut on a tip surface 67 of a pair of locking arm portions 66 (described later) of the shunt ring 7. Hereinabove, the holder 6 is described.

Next, the shunt ring 7 will be described. As illustrated in FIGS. 14A to 15B, the resin shunt ring 7 includes an approximately cylindrical main body portion 61. The fitting port 62 that is opened to the front side in the fitting direction is formed inside the main body portion 61. The connection portion 12 of the second connector 3 (refer to FIG. 3) is inserted into the fitting port 62.

The main body portion 61 is integrally provided with a cantilever-shaped fitting arm 63 that enters the internal space of the main body portion 61 from an upper end portion of a rear end portion in the fitting direction and extends toward the front side in the fitting direction. The fitting arm 63 is located facing the upper side of the fitting port 62. A protruding portion 64 protruding downward (that is, toward the inside of the fitting port 62) is formed at a tip portion of the fitting arm 63 (an end portion on the front side in the fitting direction). Between the fitting arm 63 and the inner surface of a portion on the upper side of the main body portion 61, a space 65 that is opened to the front side in the fitting direction and is spaced apart in the up and down direction is formed to extend in the fitting direction. The protruding piece 33 of the slider 5 on the side of the second connector 3 is inserted into the space 65 when the first and second connectors 2 and 3 are fitted to each other (refer to FIG. 2).

Figure 15A:
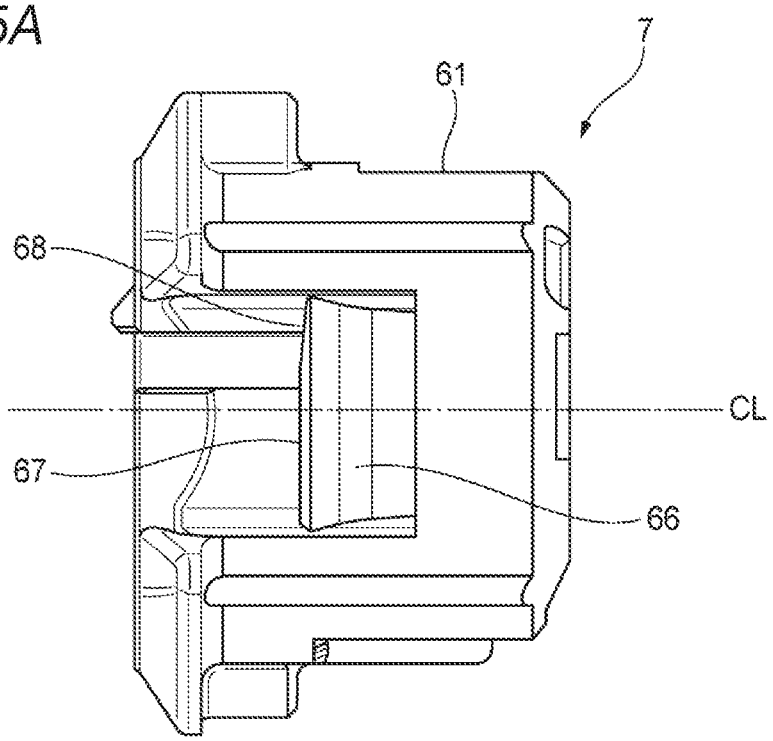
FIG. 15A is a side view of the shunt ring.

The pair of locking arm portions 66 protruding from an outer periphery and extending to the front side in the fitting direction are integrally formed at portions located on opposite sides in the width direction in the outer periphery of the main body portion 61 (also refer to FIG. 7). As illustrated in FIG. 15A, the locking arm portion 66 has a shape that is approximately symmetrical up and down with respect to the center axial line CL when viewed from the width direction.

Figure 15B:
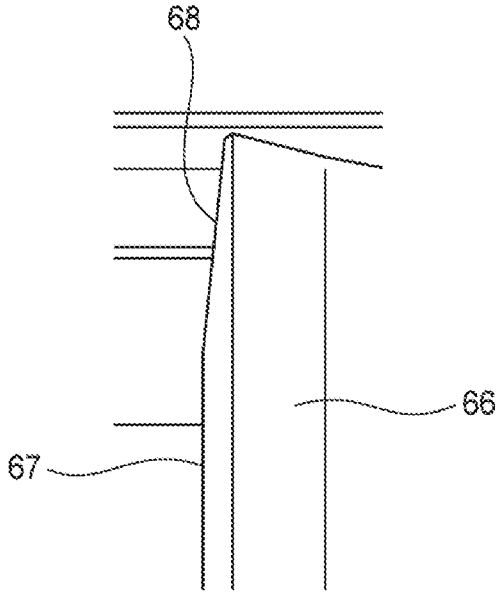
FIG. 15B is an enlarged view of a tapered surface provided on a locking arm of the shunt ring.

The tip surface 67, which is a plane extending in the up and down direction and facing the front side in the fitting direction, is formed at a tip portion of the locking arm portion 66 (an end portion on the front side in the fitting direction) (also refer to FIG. 7). However, as illustrated in FIG. 15B, in an upper region of the tip surface 67 extending in the up and down direction (a region above the center axial line CL), a tapered surface 68 is formed to be inclined to be located on the rear side in the fitting direction as approaching an upper end of the tip surface 67. Action of the tapered surface 68 will be described later. Hereinabove, the shunt ring 7 is described.

Figure 16A:
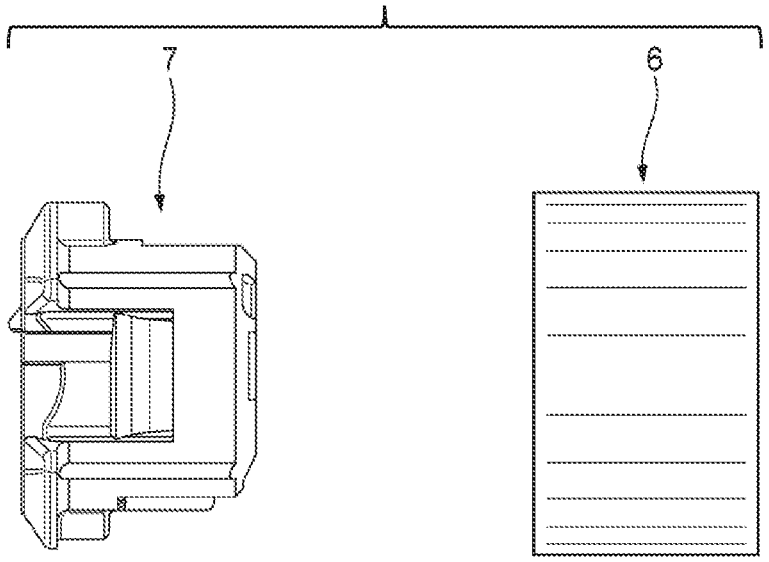
FIG. 16A is a side view illustrating a state when the shunt ring is assembled to the holder.

As illustrated in FIG. 16A, the shunt ring 7 is assembled to the holder 6 by being fitted to the internal space of the holder 6 from the opening on the front side in the fitting direction of the holder 6. In the process, the pair of locking arm portions 66 of the shunt ring 7 are temporarily elastically deformed inward in the width direction after abutting on an inner peripheral surface of the holder 6. When the tip portions thereof reach the annular groove portions 54 of the holder 6, the pair of locking arm portions 66 are elastically returned, and the tip portions thereof enter the annular groove portions 54. Accordingly, the assembly of the shunt ring 7 to the holder 6 is completed, and the first connector 2 illustrated in FIGS. 5 to 7 is obtained.

In a state where the assembly of the shunt ring 7 to the holder 6 is completed, as illustrated in FIG. 7, the tip surfaces 67 of the pair of locking arm portions 66 extending in the up and down direction facing the front side in the fitting direction, and the abutting surfaces 55 extending in the up and down direction facing the rear side in the fitting direction abut on each other in the fitting direction. As a result, the shunt ring 7 is prevented from being detached from the holder 6 to the front side in the fitting direction.

Figure 16B:
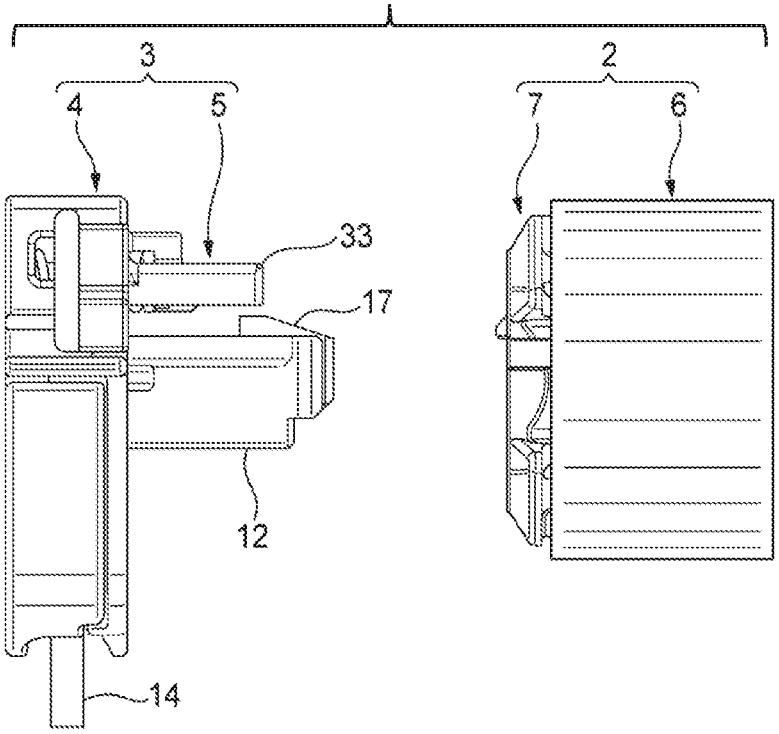
FIG. 16B is a side view illustrating a state when the first connector and the second connector are fitted to each other.

Next, a fitting operation of the first connector 2 and the second connector 3 will be described with reference to FIG. 2. In order to cause the first and second connectors 2 and 3 to be fitted to each other, as illustrated in FIG. 16B, the first and second connectors 2 and 3 are caused to be relatively close to each other in the fitting direction, and the connection portion 12 of the second connector 3 is inserted into the fitting port 62 of the first connector 2.

When the connection portion 12 is inserted into the fitting port 62, first, the protruding portion 64 of the fitting arm 63 abuts on the protruding portion 17 of the connection portion 12 and rides on the protruding portion 17, whereby the fitting arm 63 is elastically deformed upward. Therefore, the space 65 becomes narrower in the up and down direction, and thus the protruding piece 33 of the slider 5 cannot enter the space 65.

When the insertion proceeds, the tip of the protruding piece 33 of the slider 5 contact the holder 6 and attempts to enter the space 65. However, at the present stage, since the fitting arm 63 is elastically deformed upward, the protruding piece 33 cannot enter the space 65. After the stage where the tip of the protruding piece 33 of the slider 5 contacts the holder 6, the insertion proceeds while the slider 5 resists the energizing force of the coil spring 41 applied to the holder 6 by the contact between the slider 5 and the holder 6.

When the insertion proceeds and the protruding portion 64 rides over the protruding portion 17, the state where the protruding portion 64 and the protruding portion 17 are locked can be obtained by causing the fitting arm 63 to be elastically returned downward. The space 65 is widened in the up and down direction by the elastic return of the fitting arm 63, and thus the protruding piece 33 of the slider 5 can enter. Therefore, the slider 5 slides to the front side in the fitting direction with respect to the housing 4 by the energizing force of the coil spring 41, and the protruding piece 33 enters the space 65. Accordingly, the fitting operation of the first and second connectors 2 and 3 is completed, and the connector connection structure 1 illustrated in FIG. 2 can be obtained.

In a state where the fitting operation of the first and second connectors 2 and 3 is completed, the protruding piece 33 of the slider 5 is inserted into the space 65, whereby the fitting arm 63 cannot be elastically deformed upward (that is, in a direction of releasing the locking between the protruding portion 64 and the protruding portion 17). Therefore, a locked state between the protruding portion 64 and the protruding portion 17 (that is, the fitted state of the first and second connectors 2 and 3) can be firmly maintained. As illustrated in FIG. 2, when the first and second connectors 2 and 3 are fitted to each other, a locking place between the protruding portion 64 and the protruding portion 17 (locking mechanism) is located above the center axial line CL of the holder 6 of the first connector 2.

As described above, in the incompletely fitted state of the first and second connectors 2 and 3, the slider 5 acts to keep the front sides in the fitting direction of the first and second connectors 2 and 3 apart from each other by the energizing force of the coil spring 41. Therefore, it is easy to detect an abnormality in the incompletely fitted state. In the completely fitted state of the first and second connectors 2 and 3, the slider 5 is engaged with the fitting arm 63 and prevents the fitting arm 63 from being deformed in the direction of releasing the locking between the protruding portion 64 and the protruding portion 17 is released (a so-called double locking function is performed). Therefore, it is possible to more surely prevent the occurrence of the state where the first and second connectors 2 and 3 are unintentionally separated from each other.

Next, referring to FIG. 17, action and effect of the tapered surface 68 formed on the tip surfaces 67 of the pair of locking arm portions 66 of the shunt ring 7 (refer to FIG. 15B) will be described. When the connector connection structure 1 described above is used in the in-vehicle airbag system, a mode, in which an impact in a direction of separating the first and second connectors 2 and 3 from each other (a direction in which the first and the second connectors 2 and 3 move to the rear side in the fitting direction) is applied to the first and second connectors 2 and 3 fitted to each other due to activation (ignition) of the inflator, may occur.

When the above-described impact mode occurs, a locking mechanism by which the first the main body portion 61 of the shunt ring 7 on the side of the first connector 2 and the connection portion 12 of the housing 4 on the side of the second connector 3 are locked to each other (specifically, a locking mechanism between the protruding portion 64 of the fitting arm 63 and the protruding portion 17 of the connection portion 12) receives an impact in a direction of separating the main body portion 61 and the connection portion 12 from each other (a direction in which the main body portion 61 and the connection portion 12 move to the rear side in the fitting direction). When the locking mechanism receives such an impact, next, the shunt ring 7 receives an impact in a direction of relatively moving to the front side in the fitting direction with respect to the holder 6. When the shunt ring 7 receives such an impact, the tip surfaces 67 of the pair of locking arm portions 66 of the shunt ring 7 receive a reaction force from the abutting surface 55 of the holder 6 to the rear side in the fitting direction.

Here, due to a fact that the locking mechanism is located above the center axial line CL of the cylindrical portion 51 of the holder 6, the shunt ring 7 receives the impact force in a direction of relatively moving to the front side in the fitting direction with respect to the holder 6 at a location separated above the center axial line CL. Therefore, the tip surfaces 67 of the pair of locking arm portions 66 first receive the reaction force from the abutting surface 55 of the holder 6 to the rear side in the fitting direction at a location closer to the upper side in the up and down direction.

Figure 17A:
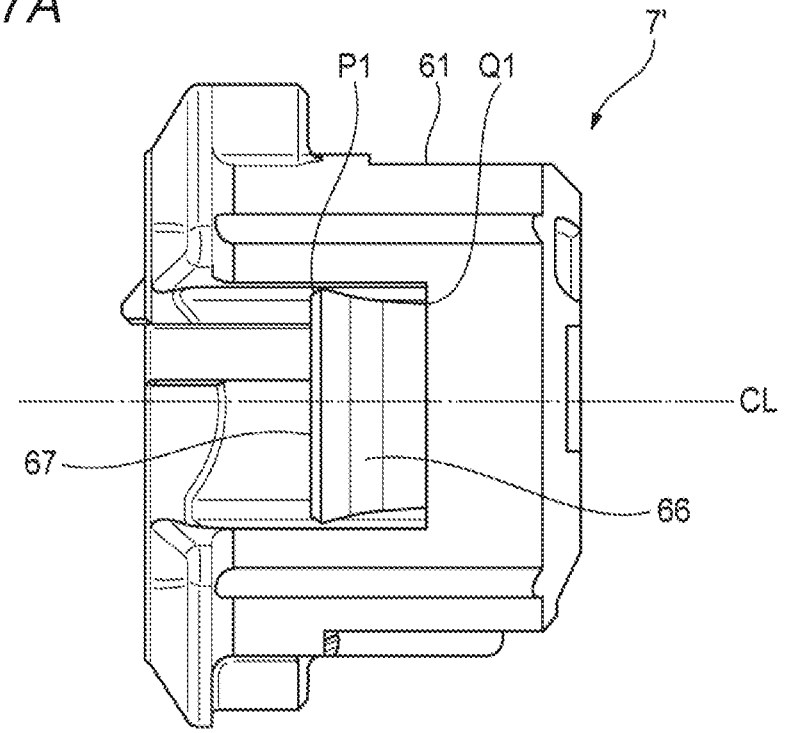
FIG. 17A is a diagram illustrating transmission of a force when an impact acts on a shunt ring according to a comparative example.

Therefore, for example, instead of the shunt ring 7 according to the embodiment, as in a case where a shunt ring 7' according to a comparative example illustrated in FIG. 17A where the tapered surface 68 is not formed is used, when both of the tip surface 67 of the locking arm portion 66 and the abutting surface 55 of the holder 6 have a simple shape extending linearly in the up and down direction over the whole region of a range in the up and down direction in which the both thereof can contact each other, the tip surface 67 of the locking arm portion 66 is easy to first receive the reaction force from the abutting surface 55 at an upper end P1 in the up and down direction. As a result, excessive compressive stress caused by stress concentration is easy to act on an upper end Q1 in the up and down direction at a root part of the locking arm portion 66.

Figure 17B:
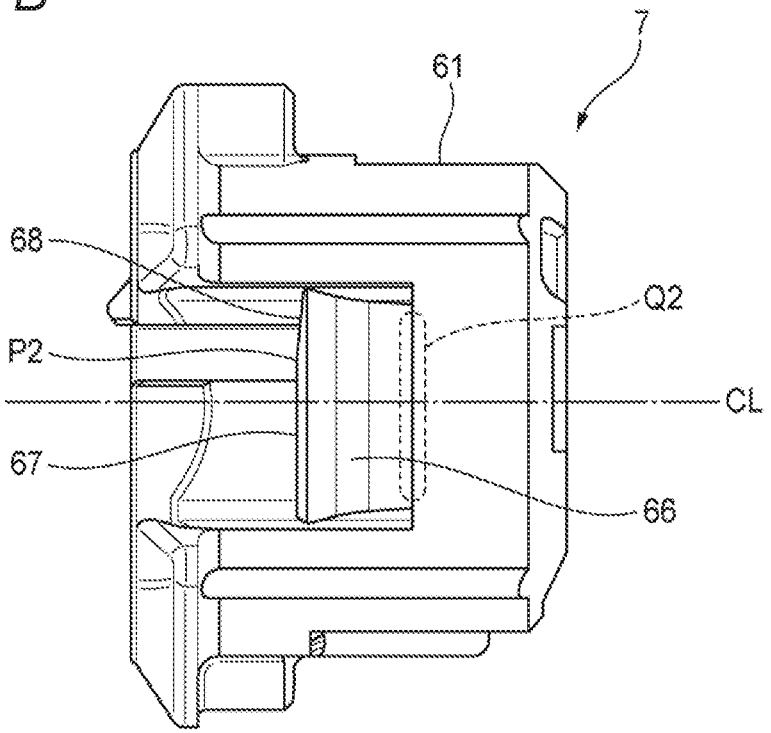
FIG. 17B is a diagram illustrating transmission of a force when an impact acts on the shunt ring according to the embodiment.

On the other hand, as illustrated in FIG. 17B, in the case of using the shunt ring 7 according to the embodiment in which the tapered surface 68 is formed, when the tip surface 67 of the locking arm portion 66 receives the force on the rear side in the fitting direction from the abutting surface 55, the pair of locking arm portions 66 and the abutting surface 55 have a structure in which a place P2 where the tapered surface 68, which is an intermediate place in the up and down direction of the tip surface 67, starts first receives the force from the abutting surface 55. Therefore, in comparison with the comparative example in which only the upper end P1 of the tip surface 67 first receives the force from the abutting surface 55, the compressive stress acting on the root part of the locking arm portion 66 is easy to be dispersed in the up and down direction (refer to a region Q2 in FIG. 17B). As a result, durability of the locking arm portion 66 (and further, durability of the connector connection structure 1) is improved.

Figure 18:
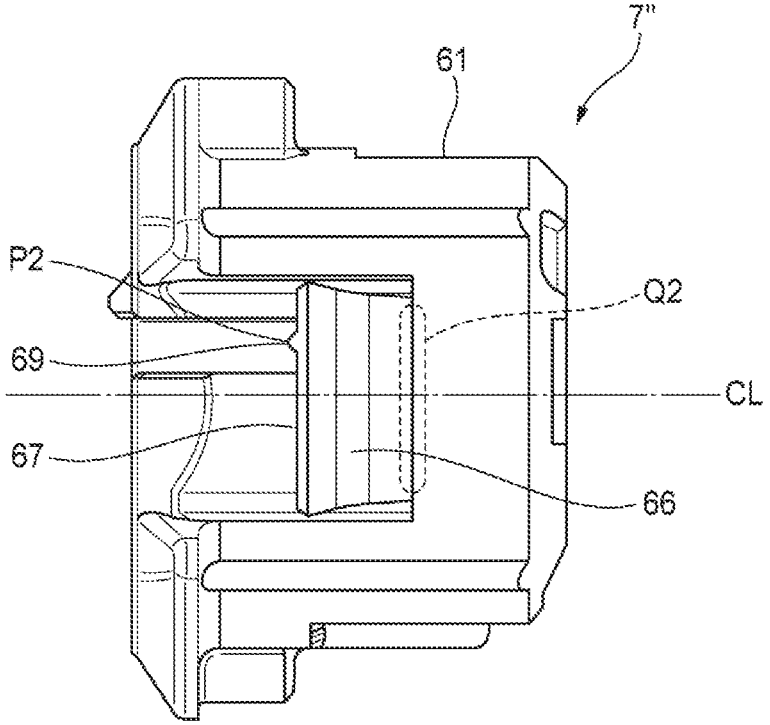
FIG. 18 is a diagram illustrating transmission of a force when an impact acts on a shunt ring according to a modification of the embodiment.

As illustrated in a shunt ring 7" according to a modification illustrated in FIG. 18, even though a protruding portion 69 protruding to the front side in the fitting direction is formed at the intermediate place P2 in the up and down direction of the tip surface 67 of the locking arm portion 66 (the same place as the place where the tapered surface 68 starts), a structure in which the intermediate place P2 first receives the force from the abutting surface 55 can be obtained, such that the same action and effect as those of the shunt ring 7 according to the embodiment can be obtained. Even though a protruding portion protruding to the rear side in the fitting direction is formed at a location corresponding to the intermediate place P2 on the abutting surface 55 of the holder 6, the same action and effect as those of the shunt ring 7 according to the embodiment can be obtained.

As described above, according to the connector connection structure 1 according to the embodiment of the present disclosure, when the tip surface 67 of the locking arm portion 66 receives the force on the rear side in the fitting direction from the abutting surface 55, the pair of locking arm portions 66 of the shunt ring 7 and the abutting surface 55 of the holder 6 have a structure in which the intermediate place P2 in the up and down direction of the tip surface 67 (refer to FIG. 17B) first receives the force from the abutting surface 55 (the tapered surface 68). Therefore, in comparison with the mode in which only the upper end P1 in the up and down direction of the tip surface 67 first receives the force from the abutting surface 55 (refer to FIG. 17A), the compressive stress acting on the root part of the locking arm portion 66 is easy to be dispersed in the up and down direction. As a result, durability of the locking arm portion 66 (and further, durability of the connector connection structure 1) is improved.

The present disclosure is not limited to the above-described embodiments, and various modifications can be adopted within the scope of the present disclosure. For example, the present disclosure is not limited to the above-described embodiments, and can be appropriately modified and improved. The material, shape, size, number, and arrangement place of each component in the above-described embodiments are freely determined and are not limited as long as the present disclosure can be achieved.

The connector connection structure 1 according to the embodiment is used for the in-vehicle airbag system. Meanwhile, the connector connection structure 1 may be used for any system as long as the system can generate the mode in which the impact in the direction of separating the first and second connectors 2 and 3 from each other (the direction in which the first and second connectors 2 and 3 move to the rear side in the fitting direction) is applied to the first and second connectors 2 and 3 fitted to each other.

Hereinafter, the embodiments of the connector connection structure 1 and connecter (first connector) 2 according to the present disclosure are summarized as follows.

According to a first illustrative aspect of the present disclosure, a connector connection structure (1) includes: a first connector (2); and a second connector (3). The first connector (1) and the second connector (3) are fitted to each other at front sides thereof in a fitting direction in which the first connector (2) and the second connector (3) approach to each other. The first connector (2) includes: a first component (6) including a cylindrical portion (51) having a center axial line (CL) of the first component (6); and a second component (7) including a main body portion (61), the main body portion (61) being housed inside the cylindrical portion (51) and internally defining a fitting port (62) to which the second connector (3) is fitted. The second component (7) includes a pair of locking arm portions (66) protruding outwardly from an outer periphery of the main body portion (61) at opposite end portions of the outer periphery in a width direction orthogonal to the fitting direction, the locking arm portions (66) having a tip surface (67), the tip surface (67) facing toward the front side of the first connector (2) in the fitting direction and extending in an up-and-down direction orthogonal to the fitting direction and the width direction. The first component (6) includes an abutting surface (55) extending in the up-and-down direction on an inner periphery of the cylindrical portion (51) and facing toward the rear side of the first connector (2) in the fitting direction, the abutting surface (55) being configured to abut on the tip surface (67) of each of the locking arm portions (66) in the fitting direction. The second connector (3) includes: a housing (4) having a connection portion (12) which is fitted to the fitting port (62); and a locking mechanism (17) configured to lock the main body portion (61) and the connection portion (12) with each other, such that a fitted state where the connection portion (12) is fitted to the fitting port (62) is not released. The locking mechanism (17) is provided at a location away from the center axial line (CL) of the cylindrical portion (51) to one side in the up-and-down direction. The pair of locking arm portions (66) and the abutting surface (55) have a structure configured such that at least one part of the tip surface (67) in the up-and-down direction first receives a force from the abutting surface (55) when the tip surface (67) of the locking arm portions (66) receives the force on the rear side in the fitting direction from the abutting surface (55).

According to a second illustrative aspect of the present disclosure, the structure includes a tapered surface (68) inclining to be located at the rear side of the first connector in the fitting direction as approaching an end of the one side in the up-and-down direction on the tip surface (67) in the up-and-down direction, the tapered surface (68) being formed in a region of the tip surface (67) of the locking arm portions (66) at the one side in the up-and-down direction.

According to a third illustrative aspect of the present disclosure, the second connector (3) includes a slider (5) held in the housing (4) to be movable in the fitting direction at a location away from the center axial line (CL) of the cylindrical portion (51) to the one side in the up-and-down direction, the slider (5) being energized toward the front side of the second connector (3) in the fitting direction with an energizing member (41). The first connector (2) and the second connector (3) are configured such that, during a fitting operation of the first connector (2) and the second connector (3) the front sides of the first connector (2) and the second connector (3) in the fitting direction approach to each other while the slider (5) resists an energizing force of the energizing member (41) applied to the first connector (2), the energizing force being caused by abutting on the slider (5) and the first connector (2). In which the slider (5) is designed to: keep the front sides of the first connector (2) and the second connector (3) in the fitting direction away from each other by the energizing force of the energizing member (41), in an incomplete fitted state where the first connector (2) and the second connector (3) are incompletely fitted to each other; and prevent the locking mechanism (17) from being deformed in a direction of releasing locking the main body portion (61) and the connection portion (12) by engaging the slider (5) and the locking mechanism (17), in a complete fitted state where the first connector (2) and the second connector (3) are completely fitted to each other.

According to a fourth illustrative aspect of the present disclosure, the first connector (2) and the second connector (3) are electrical connectors of an in-vehicle airbag system, the first connector (2) corresponding to a connector at a side of an inflator provided in the inflator of the airbag system, the second connector (3) corresponding to a connector at a side of a wire harness which supplies a control signal to the inflator.

According to a fifth illustrative aspect of the present disclosure, a connector (2) configured to be fitted to a counterpart connector (3) at front sides thereof in a fitting direction in which the connector (2) and the counterpart connector (3) approach to each other. In which the connector (2) includes: a first component (6) including a cylindrical portion (51) having a center axial line (CL) of the first component (6); and a second component (7) including a main body portion (61), the main body portion (61) being housed inside the cylindrical portion (51) and internally defining a fitting port (62) to which the counterpart connector (3) is fitted. The second component (7) includes a pair of locking arm portions (66) protruding outwardly from an outer periphery at opposite end portions of the outer periphery in a width direction orthogonal to the fitting direction, the locking arm portions (66) having a tip surface (67), the tip surface (67) facing toward the front side of the connector (2) in the fitting direction and extending in an up-and-down direction orthogonal to the fitting direction and the width direction. The first component (6) includes an abutting surface (55) extending in the up-and-down direction on an inner periphery of the cylindrical portion (51) and facing toward the rear side of the connector (2) in the fitting direction, the abutting surface (55) being configured to abut on the tip surface (67) of each of the locking arm portions (66) in the fitting direction. The counterpart connector (3) includes: a housing (4) having a connection portion (12) which is fitted to the fitting port (62) and a locking mechanism (17) configured to lock the main body portion (61) and the connection portion (12) with each other, such that a fitted state where the connection portion (12) is fitted to the fitting port (62) is not released. The locking mechanism (17) is provided at a location away from the center axial line (CL) of the cylindrical portion (51) to one side in the up-and-down direction. The pair of locking arm portions (66) and the abutting surface (55) have a structure configured such that at least one part of the tip surface (67) in the up-and-down direction first receives a force from the abutting surface (55) when the tip surface (67) of the locking arm portions (66) receives the force on the rear side in the fitting direction from the abutting surface (55).

What is claimed is:

1. A connector connection structure, comprising:

a first connector; and a second connector, wherein the first connector and the second connector are fitted to each other at front sides thereof in a fitting direction in which the first connector and the second connector approach to each other, wherein the first connector includes:

a first component including a cylindrical portion having a center axial line of the first component;

a second component including a main body portion, the main body portion being housed inside the cylindrical portion and internally defining a fitting port to which the second connector is fitted; and a pair of terminals mounted on the first component and spaced apart from each other in a width direction, wherein the second component includes a pair of locking arm portions protruding outwardly from an outer periphery of the main body portion at opposite end portions of the outer periphery in the width direction, the width direction is orthogonal to the fitting direction, each of the locking arm portions has a tip surface, the tip surface facing toward the front side of the first connector in the fitting direction and extending in an up-and-down direction orthogonal to the fitting direction and the width direction, wherein the first component includes an abutting surface extending in the up-and-down direction on an inner periphery of the cylindrical portion and facing toward the rear side of the first connector in the fitting direction, the abutting surface being configured to abut on the tip surface of each of the locking arm portions in the fitting direction, wherein the second connector includes:

a housing having a connection portion which is fitted to the fitting port; and a locking mechanism configured to lock the main body portion and the connection portion with each other, such that a fitted state where the connection portion is fitted to the fitting port is not released, wherein the locking mechanism is provided at a location away from the center axial line of the cylindrical portion to one side in the up-and-down direction, and wherein the tip surface of each of the pair of locking arm portions is asymmetric in the up-and-down direction such that at least one part of the tip surface in the up-and-down direction first receives a force from the abutting surface when the tip surface of the locking arm portions receives the force on the rear side in the fitting direction from the abutting surface.

2. The connector connection structure according to claim 1, wherein the structure includes a tapered surface inclining to be located at the rear side of the first connector in the fitting direction as approaching an end of the one side in the up-and-down direction on the tip surface in the up-and-down direction, the tapered surface being formed in a region of the tip surface of the locking arm portions at the one side in the up-and-down direction.

3. The connector connection structure according to claim 1, wherein the second connector includes a slider held in the housing to be movable in the fitting direction at a location away from the center axial line of the cylindrical portion to the one side in the up-and-down direction, the slider being energized toward the front side of the second connector in the fitting direction with an energizing member, wherein the first connector and the second connector are configured such that, during a fitting operation of the first connector and the second connector, the front sides of the first connector and the second connector in the fitting direction approach to each other while the slider resists an energizing force of the energizing member applied to the first connector, the energizing force being caused by abutting on the slider and the first connector, wherein the slider is designed to:

keep the front sides of the first connector and the second connector in the fitting direction away from each other by the energizing force of the energizing member, in an incomplete fitted state where the first connector and the second connector are incompletely fitted to each other; and prevent the locking mechanism from being deformed in a direction of releasing locking the main body portion and the connection portion by engaging the slider and the locking mechanism, in a complete fitted state where the first connector and the second connector are completely fitted to each other.

4. The connector connection structure according to claim 1, wherein the first connector and the second connector are electrical connectors of an in-vehicle airbag system, the first connector corresponding to a connector at a side of an inflator provided in the inflator of the airbag system, the second connector corresponding to a connector at a side of a wire harness which supplies a control signal to the inflator.

5. A connector configured to be fitted to a counterpart connector at front sides thereof in a fitting direction in which the connector and the counterpart connector approach to each other, the connector comprising:

a first component including a cylindrical portion having a center axial line of the first component;

a second component including a main body portion, the main body portion being housed inside the cylindrical portion and internally defining a fitting port to which the counterpart connector is fitted; and a pair of terminals mounted on the first component and spaced apart from each other in a width direction, wherein the second component includes a pair of locking arm portions protruding outwardly from an outer periphery at opposite end portions of the outer periphery in the width direction, the width direction is orthogonal to the fitting direction, each of the locking arm portions has a tip surface, the tip surface facing toward the front side of the connector in the fitting direction and extending in an up-and-down direction orthogonal to the fitting direction and the width direction, wherein the first component includes an abutting surface extending in the up-and-down direction on an inner periphery of the cylindrical portion and facing toward the rear side of the connector in the fitting direction, the abutting surface being configured to abut on the tip surface of each of the locking arm portions in the fitting direction, wherein the counterpart connector includes:

a housing having a connection portion which is fitted to the fitting port; and a locking mechanism configured to lock the main body portion and the connection portion with each other, such that a fitted state where the connection portion is fitted to the fitting port is not released, wherein the locking mechanism is provided at a location away from the center axial line of the cylindrical portion to one side in the up-and-down direction, and wherein the tip surface of each of the pair of locking arm portions is asymmetric in the up-and-down direction such that at least one part of the tip surface in the up-and-down direction first receives a force from the abutting surface when the tip surface of the locking arm portions receives the force on the rear side in the fitting direction from the abutting surface.

6. The connector connection structure according to claim 2, wherein the second connector includes a slider held in the housing to be movable in the fitting direction at a location away from the center axial line of the cylindrical portion to the one side in the up-and-down direction, the slider being energized toward the front side of the second connector in the fitting direction with an energizing member, wherein the first connector and the second connector are configured such that, during a fitting operation of the first connector and the second connector, the front sides of the first connector and the second connector in the fitting direction approach to each other while the slider resists an energizing force of the energizing member applied to the first connector, the energizing force being caused by abutting on the slider and the first connector, wherein the slider is designed to:

keep the front sides of the first connector and the second connector in the fitting direction away from each other by the energizing force of the energizing member, in an incomplete fitted state where the first connector and the second connector are incompletely fitted to each other; and prevent the locking mechanism from being deformed in a direction of releasing locking the main body portion and the connection portion by engaging the slider and the locking mechanism, in a complete fitted state where the first connector and the second connector are completely fitted to each other.

7. The connector connection structure according to claim 3, wherein the first connector and the second connector are electrical connectors of an in-vehicle airbag system, the first connector corresponding to a connector at a side of an inflator provided in the inflator of the airbag system, the second connector corresponding to a connector at a side of a wire harness which supplies a control signal to the inflator.

8. The connector connection structure according to claim 6, wherein the first connector and the second connector are electrical connectors of an in-vehicle airbag system, the first connector corresponding to a connector at a side of an inflator provided in the inflator of the airbag system, the second connector corresponding to a connector at a side of a wire harness which supplies a control signal to the inflator.

9. The connector according to claim 5, wherein the tip surface extends in the up-and-down direction, and wherein the tip surface has an intermediate surface portion and a tapered surface portion, the intermediate surface portion is parallel to the up-and-down direction, and the tapered surface portion is inclined with respect to the up-and-down direction such that the intermediate surface portion of the tip surface first receives a force from the abutting surface when the tip surface of the locking arm portions receives the force on the rear side in the fitting direction from the abutting surface.

* * * * *